US005447756A

United States Patent [19]

Kamen

[11] Patent Number: 5,447,756

[45] Date of Patent: Sep. 5, 1995

[54] METHOD OF FORMING SURFACE TREATED APPLICATORS

[75] Inventor: Melvin E. Kamen, Highlands, N.J.

[73] Assignee: Revlon Consumer Products Corporation, New York, N.Y.

[21] Appl. No.: 207,499

[22] Filed: Mar. 8, 1994

Related U.S. Application Data

[62] Division of Ser. No. 52,328, Apr. 23, 1993.

[51] Int. Cl.[6] ..... B05D 3/06

[52] U.S. Cl. ..... 427/489; 427/255.3; 427/255.6; 427/490; 427/493; 427/509; 427/515; 427/525; 427/527; 427/529; 427/535; 427/547; 427/558; 427/571; 427/574; 427/578; 427/598

[58] Field of Search ..... 427/585, 535, 571, 255.3, 427/255.6, 489, 490, 493, 509, 515, 525, 527, 529, 547, 558, 574, 578, 598

[56] References Cited

U.S. PATENT DOCUMENTS

| | | | |
|---|---|---|---|
| 4,493,866 | 1/1985 | Kim | 428/101 |
| 4,631,227 | 12/1986 | Nakamura | 428/283 |
| 5,151,229 | 9/1992 | Burns | 264/51 |

FOREIGN PATENT DOCUMENTS

| | | |
|---|---|---|
| 88402258 | of 1989 | European Pat. Off. . |
| 2023922 | of 1990 | Japan . |
| 1107758 | of 1968 | United Kingdom . |

*Primary Examiner*—Bernard Pianalto
*Attorney, Agent, or Firm*—Julie Blackburn

[57] ABSTRACT

An applicator with a surface having a first wetting angle and a first surface area, which surface area has grafted thereto a layer of ion-producing gas plasma having a second wetting angle and a second surface are, wherein the second wetting angle is less than the first wetting angle and the second surface area is greater than the first surface area.

25 Claims, 1 Drawing Sheet

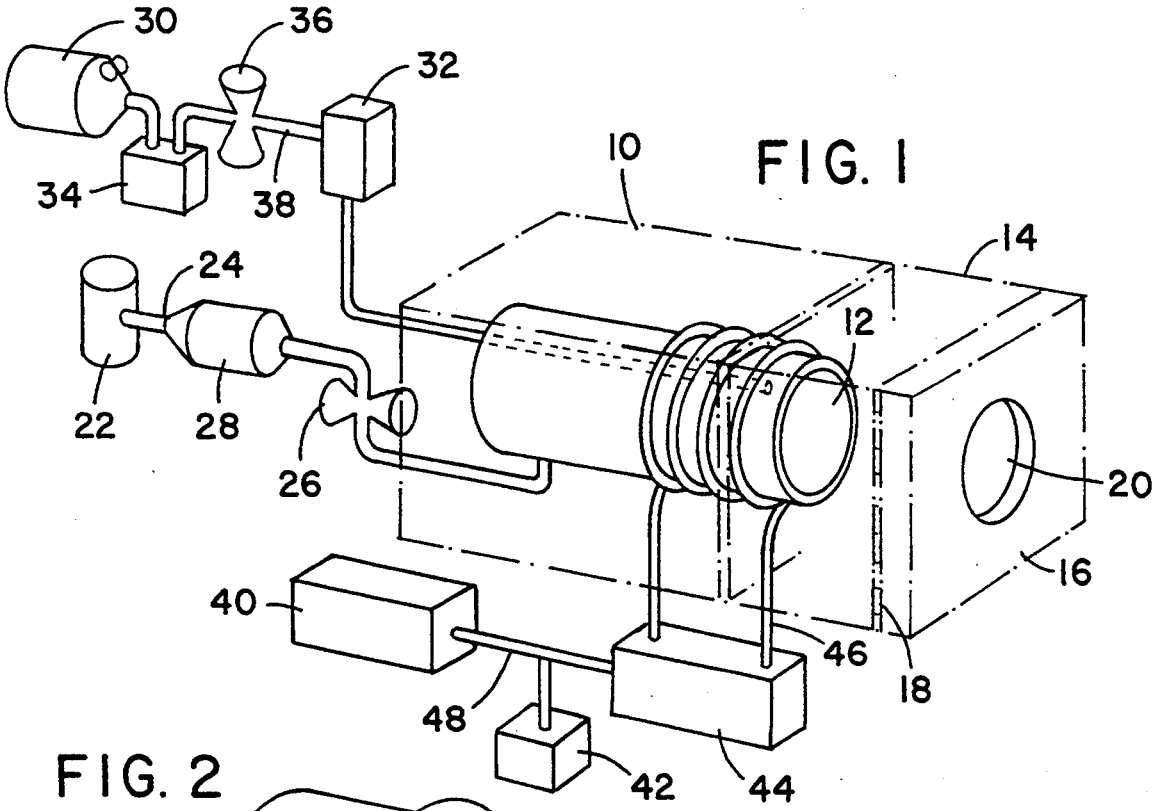
FIG. 1
FIG. 2
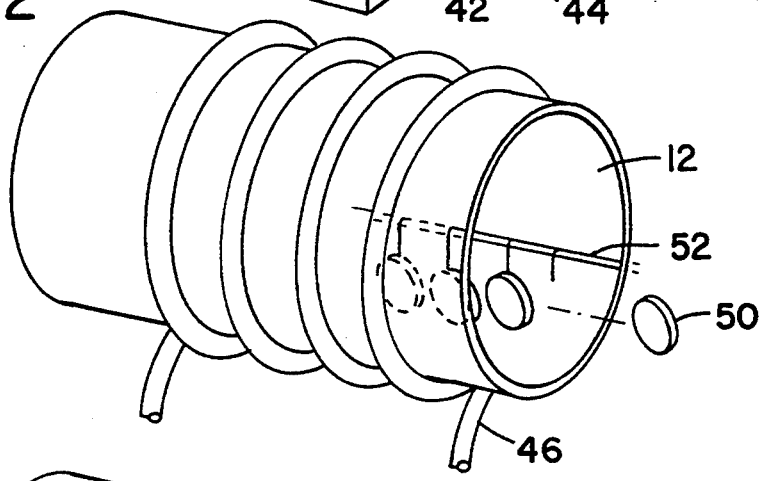
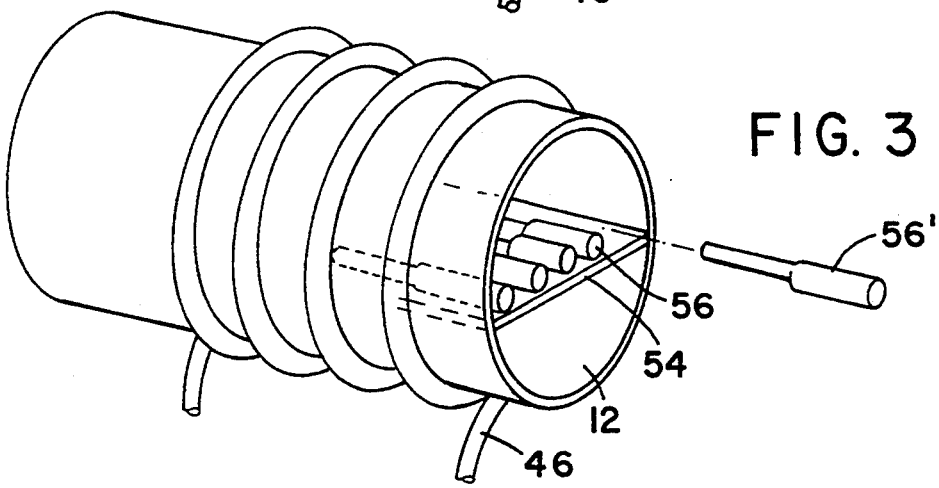
FIG. 3

METHOD OF FORMING SURFACE TREATED APPLICATORS

This is a divisional of copending application Ser. No. 08/052,328 filed on Apr. 23, 1993.

FIELD OF THE INVENTION

The invention is directed to applicators such as brushes, sponge-like absorbent applicators, and the like which have been surface treated with various plasma gas treatments to improve adherence, wettability, and other desireable characteristics.

BACKGROUND OF THE INVENTION

Various techniques for altering the surface characteristics of polymeric materials with a reactor gas in the presence of an electromagnetic field are known. For example, U.S. Pat. No. 4,072,769 teaches a technique for modifying the surface of shaped polymeric materials using a reactor gas of $N_2O$, water vapor, and the vapor of an organic compound. Another such technique is disclosed in Yagi, U.S. Pat. No. 4,508,781, wherein the surfaces of synthetic or natural polymers are fluorinated by treatment thereof with inorganic fluorides in a cold glow discharge reactor. U.S. Pat. No. 4,925,698 teaches the fluorination of polymeric materials used in the manufacture of contact lenses. U.S. Pat. No. 5,108,667 to Kamen discloses the fluorination of polymeric lipstick molds which ultimately yield lipsticks with improved surface properties. U.S. Pat. Nos. 5,200,172 and 4,978,524 teach the fluorination of cosmetic products such as lipsticks which provides them with a uniform, high gloss finish.

In general, the prior art techniques for plasma treatment have been limited to hard materials such as plastics, steel, iron, and now, cosmetics. To the best of Applicants' knowledge, surface treatment of certain applicators such as brushes, sponge-like applicators, and the like has never been performed. Further, it has most unexpectedly been discovered that plasma treatment of various applicators provides an applicator with improved hold, wettability, pickup, laydown, release, and application.

SUMMARY OF THE INVENTION

The invention is directed to an applicator with a surface having a first wetting angle and a first surface area, which surface has grafted thereto a substrate having a second wetting angle and a second surface area, wherein the second wetting angle is less than the first wetting angle and the second surface area is greater than the first surface area.

The invention is also directed to a method for simultaneously decreasing the wetting angle and increasing the surface area of an applicator surface by grafting to said applicator surface a substrate which has a wetting angle which is less than the wetting angle of the applicator surface, and a surface area which is greater than the surface area of the applicator surface.

BRIEF DESCRIPTION OF THE DRAWINGS

FIG. 1 is a schematic view of an evacuative chemical vapor deposition system which can be utilized in the cold glow discharge polymerization process in accordance with this invention. A chemical vapor deposition system is one method by which the substrate can be grafted to the applicator surface. In order to facilitate consideration and discussion, the vapor deposition system is shown in its open position without any applicators placed therein; and FIG. 2 is an exploded perspective view of a foam applicator included within a plurality of such applicators which would be suspended within the reactor chamber incorporated into the chemical vapor deposition system illustrated in FIG. 1.

FIG. 3 is an exploded perspective view of a foam wick from a series of similar wicks placed on a shelf-like rack within the reactor chamber which would be incorporated the chemical vapor deposition system illustrated in FIG. 1.

DETAILED DESCRIPTION

The term "applicator" means a device or object used to apply a substance such as paint, powder, make-up, nail enamel or the like to a surface. Included within this definition are such things as paint rollers, buffing materials (i.e. chamois cloths used to polish autos, sterling silver, etc.), cosmetic sponges, powder puffs, brushes of all types (cosmetic brushes, nail enamel brushes, mascara brushes, industrial paint brushes). In the case of brushes, the bristles may be made of natural hair material like goat, dog, horse hair, or they may be made of synthetic material such as plastic, nylon, or the like. The term "applicator" also includes foam applicators, sponge applicators, and the like, and refers to the situation where the fibers are treated prior to their manufacture into applicators.

The term "substrate" means a layer which has become grafted or chemically bonded to the applicator surface. The substrate may be affixed to the applicator surface by treatment of the surface with an ion-producing gas plasma in a evacuative chemical vapor deposition chamber in accordance with the methods disclosed in U.S. Pat. Nos. 4,508,781, 5,108,667, 5,200,172 and 4,978,524, all of which are hereby incorporated by reference. The substrate can also be grafted to the applicator surface by other methods such as treatment of the applicator surface with halogens in the presence of ultraviolet radiation as disclosed in U.S. Pat. No. 4,593,050 which is hereby incorporated by reference.

The term "ion-producing gas" means a gas which produces ions in the presence of ultraviolet radiation or in a chemical vapor deposition chamber in the presence of an electromagnetic field. Examples of such gases include fluorocompounds such as $C_{1-10}$ fluoroalkyls, air, nitrogenous gases, helium (He), argon (Ar), nitrous oxide ($N_2O$), fluorosilicons, and mixtures thereof.

The term "wetting angle" or "contact angle" means the angle which exists between a specific liquid and a specific solid surface. This measurement gives an indication of the relative values of the forces of adhesion and cohesion that result in interfacial tension. As used herein, this term also means the ability of a specified solid surface to be wet by a specified liquid under defined conditions. The smaller the wetting angle of a surface, the greater the wettability of its surface by a specific liquid and vice versa.

The term "decreased wetting angle" means that the wetting angle of the applicator treated in accordance with the invention has decreased 5–99%, preferably 20–75% when compared to the wetting angle of the original applicator surface before treatment according to the invention. For example, the synthetic bristles of an industrial paintbrush may have a wetting angle of 42° prior to any surface modification treatment, meaning that each individual bristle has a separate wetting angle close to 42° and together, collectively the bristles have a wetting angle of approximately 42°. After treatment according to the invention, the substrate applied to the bristles causes the wetting angle of the individual bristles to decrease so that collectively they yield a wetting angle of about 21°. The wetting angle has decreased 50 percent. A goniometer apparatus is usually used to measure wetting angles according to processes well known to those skilled in the art.

The term "electromagnetic field" means fields created by cold-glow discharge or similar means, the end result being the creation of a electromagnetic field.

The term "laydown" means the degree and ease with which an applicator releases its load.

The term "pickup" means the degree to which an applicator is able to take up the substance to be applied when it is dipped into the substance or scraped or rubbed against the substance.

The term "application" means the way in which an applicator applies the substance to a surface. It is most desireable to have very smooth, even application without clumping or streaking, characteristic of natural fiber applicators. Synthetic applicators generally do not provide a smooth, even, application of this quality.

The treatment process of the invention causes the applicator to have a decreased wetting angle and an increased surface area. The treatment causes a decrease of 5–99%, preferably 20–75% in the wetting angle. The increase in surface area of the applicator surface is attributable to the fact that the gas plasma forms an uneven or "bubbled" layer on the applicator surface which is referred to as "etching". In general, the treatment process of the invention yields an applicator having etched surfaces wherein the grafted layer of the gas plasma on the surface ranges from 50–5000 Angstroms. For example, if a synthetic nylon industrial paintbrush is treated according to the invention, generally a 50–5000 Angstrom etched layer of the gas plasma becomes grafted to the bristle surfaces. The term "grafting" or "grafted" means that the gas plasma constituents chemically react with the bristle surfaces forming a deposit which bonds to the bristle surface. Generally the wetting angles of suitable applicators prior to treatment range from 100°–200°. The treatment causes the wetting angle to decrease to about 1°–99°.

The method of the invention has substantial advantages. Generally brushes made from natural fibers such as goat, dog, or horse hair are the most desireable in terms of quality, pickup, laydown, and ease of application. But expense and problems with availablility often make it economically unfeasible to use natural fiber brushes for mass market purposes. In addition, natural fiber brushes require sterilization prior to commercial use due to natural biological contaminants. Most unexpectedly, the plasma treatment processes of the invention provides synthetic bristle brushes which exceed the results achieved with natural fiber brushes at considerably less expense. It has also been discovered that when the plasma treatment process of the invention is performed on foam applicators, the applicators are far less prone to yellow and crack. Yellowing and cracking of foam is one common problem associated with foam applicators.

Although the method of the invention may be used with all types of applicators, the preferred embodiment is directed to cosmetic applicators such as mascara brushes, makeup brushes, foam applicators and the like.

DETAILED DESCRIPTION OF THE DRAWINGS

FIG. 1 shows a chemical vapor deposition system 10 in which a cylindrical reactor chamber 12 is encased within an evacuative gas plasma treatment chamber 14. The evacuative gas plasma treatment chamber 14 has a chamber door 16 which is closeably affixed thereto by means of a "piano" hinge 18. The gas plasma treatment chamber door 16 is provided with a viewing window 20. The chemical vapor deposition system 10 includes, in addition to the reaction chamber 12, a vacuum pump 22 which is connected to the reactor chamber 12 by means of a vacuum outlet line 24. A vacuum outlet valve 26 and a vacuum pressure gauge 28 are positioned in series in the vacuum pump 22 to regulate the vacuum pressure. Further included are a gas supply source 30, a gas inlet chamber 32, and a gas recovery chamber 34. A gas inlet valve 36 is positioned in a gas flowline 38 between the gas supply source 30 and the cold trap 34 to regulate the flow rate of the gas (not shown). Also included in the chemical vapor deposition system 10 are a radio frequency oscillator 40 which is connected to a power source (not shown), a wattmeter 42, and an impedance network 44, to which an inductive coil 46 is connected. The inductive coil 46 is loosely wound around the reactor chamber 12 to assure an even distribution of the electrical discharge from the frequency oscillator 40 throughout the entire reactor chamber 12. The frequency oscillator 40 and the impedance network 44 are connected in series by a current flowline 48, with the wattmeter 42 connected in between to measure the flow rate of the current. Treatment gas is supplied from the gas supply source 30 to the reactor chamber 12 through the gas flowline 38, which includes a gas recovery chamber 34 valve, a gas inlet valve 32, and a gas inlet chamber 32 connected there within in series.

With the vacuum outlet valve 26 open and the chamber door 16 closed, the reactor chamber 14 is evacuated through the vacuum outlet line 24 by means of the vacuum pump 22 until a vacuum measurement of 50 microns (0.5 T) or less is achieved. After such a vacuum has been created in the evacuative gas plasma treatment vacuum outlet chamber 14, the vacuum outlet valve 25 is closed, and the gas inlet valve 36 is opened when a vacuum measurement of about 50 microns is reached.

The treatment gas is maintained in the reactor chamber 14 for a length of time (from about 2 to 15 minutes) sufficient to permit the treatment gas to saturate the surface of the applicator 50 (see FIG. 2) contained in the reactor chamber 12. At the end of the saturation period the inductive coil 44 within the evacuative gas plasma treatment chamber 14 is energized to generate a plasma throughout the reactor chamber 12. The plasma in turn causes a chemical reaction between the treatment gas and the applicator 12. As a result of such a chemical reaction, the treatment gas becomes grafted to the applicator surface. The applicator surfaces are now etched with a thin layer of ion-producing gas plasma (see FIG. 2) which is more wettable by most substances, particularly liquid cosmetic products. Furthermore, the layer is characterized by cladding-like properties. Typically, the surface of the applicator 50 has a thickness in a range of from about 50 angstroms to about 3000 angstroms. A more detailed discussion of the halogenated plasma treatment is set forth in U.S. Pat. No. 4,404,256 which is hereby incorporated by reference.

At the conclusion of the plasma treatment process (usually about 2–60 minutes) the gas inlet valve 32 is closed, while the valve 54 is left open until the pressure in the vacuum chamber 14 equalizes that of air or atmospheric pressure. Now the vacuum outlet valve 26 can be closed and the vacuum chamber 14 can be opened. After opening the vacuum chamber 14, each of the applicators 50, (see FIG. 2) are removed. Because the plasma treatment is conducted at room temperature, the applicators 50 do not undergo any appreciable distortion.

Due to the fact that some applicators contain moisture, the refrigerated cold trap 4, which is maintained at all times, must be employed to collect any moisture removed from the foam applicator 50 during the evacuation of the vacuum chamber 12 to prevent moisture from contaminating the vacuum pump 22. Moisture is removed from the boundary of the applicator 50 only, leaving the interior of the applicator 50 with essentially the same moisture content that it had prior to the plasma treatment process.

FIG. 2 is a three-dimensional illustration of a string of disc-shaped foam applicators 50 suspended by means of a cord 52, in an upright position between the inner walls of the reactor chamber 12 within the gas plasma treatment chamber 14 as shown in FIG. 1. When the reactive chamber 12 is operating at full capacity, a series of at least eight strings of disc-shaped applicators 50 or equivalent type would be suspended within the reactor chamber 12. In order to maximize the capacity of the gas plasma treatment reactor chamber 12, the greatest number of absorbent applicators which would not inhibit thorough ionic halogenation of the surfaces thereof should be utilized. Once the reactor chamber 12 has been loaded, it is closed in preparation for the performance of a plasma treatment process using a chemical vapor deposition system 10 shown in FIG. 1.

FIG. 3 is a three-dimensional illustration of the reactor chamber 12, having a shelf-like rack 54 positioned therein, upon which a series of synthetic foam wicks 56 have been placed for gas plasma treatment according to this invention. The foam wick 56 shown in an exploded view is identical to those mentioned previously. Several shelf-like racks 54 can be utilized simultaneously to treat a larger number of applicators at once.

The treatment gas can be any inert, oxygen-free gas as well as air itself. For the purposes of this invention, it is preferred that helium, fluorine, or another halogen be utilized. In fact, any plasma reactive gas capable of bonding (chemically and possibly mechanically) to the surface of the absorbent applicator-type cosmetic product could be used as the treatment gas. Even non-plasma reactive gasses are suitable.

If the treatment gas is $C_2F_4$, $C_2F_6$, $SiF_4$, $F_2$ and $CF_4$, $O^2$, $N_2$, $N_2O$ or the like, the halogenated surface layer would be more wettable to non-polar compounds such as halogenated silicone oils, etc. By using air as the treatment gas, the halogenated surface layer would be more wettable to polar compounds such as water, alcohol, etc.

Example 1

A series of disc-shaped cosmetic foam applicators comprised of a commercially available polyurethane were processed in accordance with this invention. The foam applicators were suspended from a nylon cord attached by non-metallic clips at opposite ends of the reaction chamber to form a string thereof. The two opposite ends of the string of foam applicators were attached to opposite walls of a vacuum chamber such as that illustrated in FIG. 1. A commercially available gas plasma treatment chamber supplied by Branson/International Plasma Corp. (Division of Smith Kline, Philadelphia, Pa.) was utilized to modify the surfaces of the foam applicators. The foregoing vacuum chamber assembly, having the string of disc-shaped foam applicators suspended within, was incorporated into a chemical vapor system similar to that shown in FIG. 3, and the fluorination process was carried out as follows:

The string of suspended foam applicators positioned within the vacuum chamber were treated with a gas containing about 5 percent by volume of tetrafluoromethane ($CF_4$) in a mixture of nitrous oxide ($N_2O$) and air. The gas was introduced into the vacuum chamber. Because of the porosity of the foam applicator surfaces, a mixture of $N_2O$ and air, instead of helium was utilized as a carrier gas to ensure complete fluorination. Initially the vacuum pressure was gradually adjusted to a level of 50 microns or less and thereafter adjusted to a level not in excess of 5 microns. The contents of the vacuum chamber were then flushed with helium gas which was introduced at an increased level of from about 200 up to about 1000 microns. After about five minutes, the vacuum chamber was re-evacuated to a pressure of from about 5 to about 50 microns. The fluorinated gas was then introduced into the vacuum chamber and maintained therein for a period of between 30 seconds and 15 minutes so as to allow complete saturation throughout the surface of the foam applicators. Upon completion of the $CF_4$ saturation, a cold glow discharge was generated throughout the vacuum chamber by means of direct electrical excitation at a power level of between about 50 to about 500 Watts, thus initiating the chemical reaction of the plasma with the surfaces of the foam applicators. The plasma gas treatment was carried out from about 5 to about 6 minutes. Thereafter, the pressure within the vacuum was re-adjusted to ambient conditions, and the foam applicators were removed from the vacuum chamber. The treated products displayed undistorted sponge-like surfaces.

Subsequent testing of the foam applicators indicated that the surfaces had been fluorinated to a thickness off between 500 and 2000 angstroms and that the respective wetting angles had been decreased from about 120–130 to about 70–80 degrees. The foregoing results, which reflected a significant decrease in wetting angle were determined by means of a coventional ESCA and a goniometer, respectively.

Example 2

The procedural steps outlined in Example 1, supra, were repeated, except the respective surfaces of a series of synthetic foam wicks similar to those illustrated in FIG. 3 were modified in accordance with this invention. $CF_4$ was similarly utilized as the halogenating compound throughout the series along with a mixture of $N_2O$) and air as the carrier gas during the gas plasma treatment. Helium was used to flush the reactor chamber before and after the halogenation procedure.

Upon being subjected to a relative absorbency and buoyancy test, the modified foam applicators exhibited a tremendous increase in absorbency. The foregoing test involves placing a modified foam applicator along with a control foam applicator into a container of water. The tremendous increase in absorbency of the test foam applicator was evidenced by the fact that it sunk to the bottom of the container. In contrast, the control applicator continued to float on the water surface.

Based on visual inspection and the test results as described above, the surface modified foam wicks of this example were comparable to those obtained in Example 1.

Example 3

The following applicators were treated according to the invention:

12 nylon brushes
15 mascara brushes
12 nail enamel brushes

Duplicate samples of all the above were retained for comparison as controls.

The clean applicators were placed in a non-metallic holder 20–25 pieces at a time. The holder was either plastic or paper boxes or plastic tube holders. The holders were then placed into a gas plasma treatment chamber (Branson International Plasma Corp., Division of Smith Kline, Philadelphia, Pa.). The vacuum was turned on to 0.1 T to outgas components for one hour. After one hour of vacuum, the gas was purged through the chamber for one minute while the vacuum was adjusted to 0.5 T. The gas comprised about 5% by volume of $CF_4$, nitrogen, air, or $N_2O$ or mixtures thereof. The RF generator power switch was turned on until the power level reached 50–200 watts. After the gas plasma started, the vacuum was readjusted to 0.5 T and the run was timed for 15–30 minutes. The vacuum was occasionally readjusted to 0.5 T during the 30 minute interval. After 30 minutes, the gas, power, and vacuum were turned off. The chamber was flushed with nitrogen gas to break the vacuum by turning on the purge switch. The chamber pressure then returned to atmospheric pressure. The door was opened and the applicators were removed and stored in clean, sealed plastic bags.

Example 4

The applicators treated according to Example 3, supra, were evaluated against the untreated controls. Nylon brushes were evaluated for pickup, laydown, and general application of powder as well as similarity to natural fiber brushes such as goat hair. Natural fiber brushes are generally the best for laydown, pickup and application. Mascara brushes were evaluated for the same characteristics using Revlon's Long and Lustrous mascara formulation. The results are as follows:

| Run | Gas | Applicator | Time/Watts/Torr. | Results |
|---|---|---|---|---|
| 081192-2 DFG3-5-1 | $CF_4$ | nylon brush | 15/150/.5 | pickup was better than control. Comparable to untreated goat hair brush best application |
| 082592-1 DFG3-5-2 | $CF_4$ | nylon brush | 15/100/1 | pickup better than control and $N_2O$ treated, not as good as DFG3-5-1 |
| 081392-1 DFG3-5-3 | $N_2$ | nylon brush | 30/50/.5 | comparable to control for pickup. Sample has slightly more evenness on application |
| 081892-2 DFG3-5-4 | $N_2O$ | nylon brush | 15/150/.5 | better than control. |
| 081892-2 DFG3-5-5 | air | nylon brush | 30/50/.5 | comparable to control |
| 081892-1 | $N_2$ | nylon brush | 15/50/.5 | better than control comparable to DFG3-5-2 |
| 081892-3 DFG3-5-8 | $N_2$ | nylon brush | 15/100/.5 | better than control comparable to DFG3-5-6 |
| 081292-2 DFG3-5-8 | $N_2O$ | nylon brush | 15/50/.5 | better than control not as good as DFG3-5-4 |
| 081292-1 DFG3-5-9 | $N_2O$ | nylon brush | 15/100/.5 30/11/.5 | better than control comparable to goat hair |
| 082092-2 DFG3-5-11 | $N_2O$ | foam | 15/100/.5 | better than control best application |
| — | $N_2O$ | foam | 15/75/.5 | better than control not as good as DFG3-5-11 |
| 082092-3 DFG3-6-1 | $N_2O$ | nylon brush | 15/100/.5 | comparable to control |
| 082592-2 DFG3-6-3 | $N_2O$ | nylon brush | 30/100/1 | slightly different brush to control. Very even laydown, pickup comparable to control |
| 080692-1 DFG3-9-1 | * | masc. brush | 16/150/— | overall slightly bettter than control |
| 080592-1 DFG3-9-2 | ** | masc. brush | 5/200/— | overall slightly better than control |
| 071492-1 DFG3-9-3 | *** | masc. brush | 15/150/— 1 hr. vac. | overall slightly better than control |
| 071692-1 DFG3-9-4 | **** | masc. brush | 15/1 50/— 1 hr. vac. | overall slightly better than control |

*gas = 1 min. $O^2$ and 15 min. $CF_4$
**gas = 50/50 mixture $CF_4/O^2$
***gas = 1 m. $CF_4$
****gas = 1 m. NO3

Treated applicators showed significant improvement in laydown, pickup and application when compared to untreated controls. Moreover, treated nylon brushes exhibited performance similar to that of natural fiber brushes.

The invention discloses novel, improved applicators and provides a method for preparing these applicators.

As a result of the decreased wetting angle caused by the modification treatment, the applicator becomes significantly more wettable by substances which prior to the treatment were considerably less absorbable. The present novel plasma gas treatment process offers an especially advantageous technique which converts the normal hydrocarbonous-based surface of absorbent applicator-type products such as natural or synthetic sponge "balls" or pads, brushes, foam wicks, pen and pencil tips, and numerous other applicators to a more easily wettable surface.

What is claimed is:

1. A method for simultaneously decreasing the wetting angle and increasing the surface area of an applicator surface comprising subjecting said applicator surface to an ion producing gas which, upon exposure to electrical excitation or ultraviolet radiation, releases ions which become chemically bonded to the applicator surface and form a layer having a wetting angle which is less than the wetting angle of the applicator surface and a surface area which is greater than the surface area of the applicator surface.

2. The method of claim 1 wherein the ion producing gas is subjected to electrical excitation.

3. The method of claim 2 wherein the electrical excitation is achieved by a chemical vapor deposition system in the presence of a magnetic field.

4. The method of claim 3 wherein the ion producing gas is a halogen, helium, nitrous oxide, nitrogen, oxygen, argon, air, fluorosilicons, $C_{1-0}$ fluoroalkyls, or mixtures thereof.

5. The method of claim 4 wherein the layer is chemically bonded to the applicator surface and has a thickness of 50–5000 Angstroms.

6. The method of claim 5 wherein the layer has a wetting angle which is 5°–99° less than the wetting angle of the applicator surface.

7. The method of claim 6 wherein the surface area of the layer is 10–90% greater than the surface area of the applicator surface.

8. The method of claim 7 wherein the wetting angle of the applicator surface is 100°–200°.

9. The method of claim 8 wherein the wetting angle of the layer is 1°–99°.

10. The method of claim 9 wherein the ions are fluorine.

11. The method of claim 10 wherein the layer is 500 to 2000 Angstroms thick.

12. A method for simultaneously decreasing the wetting angle and increasing the surface area of an applicator surface comprising the steps of:

(a) placing the applicator in a chemical vapor deposition system;

(b) introducing an ion-producing gas into the reaction chamber; and (c) energizing the ion-producing gas to cause the formation of ions which react with the applicator surface;

wherein the ions form a layer on the surface of the applicator, which layer has a wetting angle which is less than the wetting angle of the applicator surface and a surface area which is greater than the surface area of the applicator surface.

13. The method of claim 12 wherein the chemical vapor deposition system comprises a reaction chamber, a vacuum pump, and a gas supply source.

14. The method of claim 13 wherein the reaction chamber is evacuated prior to introducing the applicator.

15. The method of claim 14 wherein the ion producing gas is a halogen, helium, nitrous oxide, nitrogen, oxygen, argon, air, fluorosilicons, $C_{1-10}$ fluoroalkyls, or mixtures thereof.

16. The method of claim 15 wherein the ion-producing gas is allowed to saturate the applicator prior to energizing.

17. The method of claim 16 wherein the ions form a 50–5000 Angstrom thick layer chemically bonded to the surface of the applicator.

18. The method of claim 17 wherein the wetting angle of the layer is 1°–99° less than the wetting angle of the applicator surface.

19. The method of claim 18 wherein the surface area of the layer is 10–90% greater than the surface area of the applicator surface.

20. The method of claim 19 wherein the ions which become chemically bonded to the applicator surface are fluorine, nitrogen, oxygen, argon, or helium.

21. A method for simultaneously increasing the wetting angle and increasing the surface area of an applicator surface comprising subjecting said applicator surface to an ion producing gas which, upon exposure to electrical excitation or ultraviolet radiation, releases ions which become chemically bonded to the applicator surface and form a layer having a wetting angle which is greater than the wetting angle of the applicator surface and a surface area which is greater than the surface area of the applicator surface.

22. The method of claim 21 wherein the ion producing gas is subjected to electrical excitation.

23. The method of claim 22 wherein the ion-producing gas is a fluorosilicon, a $C_{1-10}$ fluoroalkyl, a halogen, nitrous oxide, nitrogen, oxygen, air, or mixtures thereof.

24. The method of claim 23 wherein the ion-producing gas is nitrous oxide, nitrogen, oxygen, air, or mixtures thereof, either alone or in combination with a halogen, a $C_{1-10}$ fluoroalkyl or a fluorosilicone.

25. The method of claim 24 wherein the layer has a thickness of 50 to 5000 Angstroms.

* * * * *